US005756162A

United States Patent [19]

Bae et al.

[11] Patent Number: 5,756,162

[45] Date of Patent: May 26, 1998

[54] METHOD FOR MANUFACTURING SENDUST CORE POWDER

[75] Inventors: Kwang Wook Bae; Jun Byun, both of Seoul, Rep. of Korea

[73] Assignee: Samsung Electro-Mechanics Co., Ltd., Kyongki-do, Rep. of Korea

[21] Appl. No.: 692,063

[22] Filed: Aug. 7, 1996

[30] Foreign Application Priority Data

Aug. 31, 1995 [KR] Rep. of Korea ..... 1995-28376

[51] Int. Cl.[6] ..... B05D 1/02; B22F 9/08; B22F 9/02; B22F 9/06

[52] U.S. Cl. ..... 427/421; 148/104; 148/105; 75/332; 75/337; 75/342; 75/768

[58] Field of Search ..... 148/104, 105; 75/332, 337, 342, 768; 427/421

[56] References Cited

U.S. PATENT DOCUMENTS

| | | | |
|---|---|---|---|
| 3,498,918 | 3/1970 | Copp | 148/104 |
| 3,551,532 | 12/1970 | Laird | 75/337 |
| 3,777,295 | 12/1973 | Laing | 148/104 |
| 4,177,089 | 12/1979 | Bankson | 148/31.55 |
| 4,272,463 | 6/1981 | Clark et al. | 264/12 |
| 4,956,011 | 9/1990 | Nishida et al. | 75/230 |
| 5,470,399 | 11/1995 | Bae | 148/104 |

FOREIGN PATENT DOCUMENTS

| | | | |
|---|---|---|---|
| 60-145949 A2 | 8/1985 | Japan | C04B 35/00 |
| 62-250607 | 10/1987 | Japan . | |
| 63-283300 | 8/1990 | Japan | C09D 1/02 |
| 3-48241 | 7/1991 | Japan . | |

*Primary Examiner*—Shrive Beck
*Assistant Examiner*—Michael Barr
*Attorney, Agent, or Firm*—Lowe Hauptman Gopstein & Berner

[57] ABSTRACT

A method for manufacturing a powder for sendust core is disclosed which is used in power supplies, converters and invertors, and in which the sendust powder is manufactured by applying the atomizing process, and the powder is coated with a special ceramic mixture insulator, so that the core loss would be small after forming a product. The method for manufacturing the powder for a sendust core includes the steps of: preparing a sendust alloy melt composed of (in wt %) 4–13% of Si, 4–7% of Al, and balance of Fe under an inert atmosphere; spouting water with a pressure of 1500–3500 psi to a flow of said sendust alloy melt through four or more nozzles having a diameter of 10–20 mm, so as to form a relatively regular polyhedral powder; adding 0.1–1.0 wt % of kaoline to the powder, and heat-treating it at a temperature of 700°–850° C. for 30 minutes or more under a reducing atmosphere; and carrying out a wet coating on the heat-treated powder by using 0.5–5% (relative to the weight of the powder) of a composite ceramic composed of milk of magnesia, kaoline and sodium silicate.

4 Claims, 2 Drawing Sheets

METHOD FOR MANUFACTURING SENDUST CORE POWDER

BACKGROUND OF THE INVENTION

1. Field of the Invention

The present invention generally relates to a method for manufacturing a powder for sendust core which is used in power supplies, converters and invertors, and more particularly, to a method for manufacturing a sendust core powder in which the loss generated is small.

2. Description of the Prior Art

Generally, a sendust core is a toroidal core which is manufactured by using an alloy powder having a composition of 85Fe-9Si-6Al. It is a kind of a compression-formed steel core such as an iron powder core, permalloy powder core (MPP) and ferrite core, which is used as inductors or transformers. That is, it is an electronic component which is used in power supply unit and the like.

Generally, the sendust alloy is composed of 4–13% of Si, 4–7% of Al, and balance of Fe.

Among the above mentioned cores, the sendust core has the highest magnetic flux density, is suitable for high current, and is most widely used. The characteristics of the core are influenced most greatly by the state of the powder.

The sendust core powder is manufactured in the following manner. As shown in FIG. 1, a sendust alloy is formed into an ingot. The ingot is then crushed with a jaw crusher, a hammer mill, or an attrition mill. A heat treatment is carried out. The powder is then coated with sodium silicate for insulation.

The sendust core powder thus manufactured is then subjected to a lubricant addition, forming, baking, evaluation of characteristics, followed by application of an outer coating (organic polymer coating), to complete the sendust core product.

In the above described sendust core powder manufacturing method, the ingot is crushed into particles of a proper size, and therefore, it is uneconomical in view of the cost and the number of process steps. Particularly, the powder has irregular sharp corners, and therefore, the coating efficiency is low. Further, during a high pressure forming, the coating layers are damaged, with the result that the core loss is increased.

To simplify the manufacturing process and to improve the ingot crushing method, a gas atomizing method is disclosed in Japanese Patent Application Laid-open No. Sho-62-250607. In this method, a melted alloy is subjected to a gas atomizing process to prepare a crude spherical powder. Crushing is then carried out through one or two steps into particle sizes of 40–110 μm. Subsequently, the surface of the powder is coated with an inorganic insulating material (sodium silicate) to complete the core manufacture.

Compared with the ingot crushing method, this method has the advantages that the process is shortened, and segregation of the ingredients can be prevented.

However, in this method, the spherical form is highly perfect, and therefore, the compression forming becomes difficult. Even if the forming is realized, the strength of the formed body is very low, with the result that the product manufacturing is very difficult. Therefore, a crushing step is necessarily required.

Thus, in this method also, the crushing is carried out, and therefore, sharp corners are produced. The insulating coating layers are destroyed during the compression forming, and therefore, a large loss is resulted.

Japanese Patent Application Publication No. Hei-3-48241 is another example of a method for manufacturing Fe—Si—Al alloy powder. In this method, the alloy melt is freely dropped through a nozzle of 5 mm into water to form coarse flake particles. Crushing is then carried out through one or two steps, thereby obtaining the desired particle size.

However, in this method also, the coarse flake particles are crushed to obtain the final powder. Therefore, the insulating coated layers are destroyed during the compression forming, resulting in large losses.

The present invention relates to the atomizing method which will be described below.

Generally, the atomizing method is carried out in the following manner. Gas or water is spouted to the flow of a melt, thereby manufacturing a powder. This atomizing method is widely used in fabrication of materials. However, in the functional material fields of MPP core or Sendust core manufacture, the technique that the final powder is manufactured by the atomizing method has not been proposed, and the reason is as follows.

First, in the case of the sendust alloy, it is composed of highly oxidable elements. Therefore, in the case where the melt is maintained in the air, the adjustment of the ingredients is not easy.

Second, as shown in Japanese Patent Application Laid-open No. Sho-62-250607, when atomizing is carried out, the powder has an almost spherical shape, and the desired particle size is difficult to obtain. Further, even after fabrication (which is the post process), the strengths cannot be maintained. Therefore, after atomizing, crushing has to be carried out into the desired particle size. Therefore, it is unavoidable that sharp corners are produced.

Further, in the case where water is used in the atomizing, the powder is formed in the shape of flat particles or irregular particles.

Therefore, in the manufacture of structural materials, the irregular particles have large surface areas, and therefore, a large driving force of sintering power is obtained, with the result that the final density is increased.

However, the powder has be coated with an insulating material in the sendust core manufacture, and therefore, the destruction of the insulating layer during the fabrication has to be considered. Therefore, a powder of regular size is required, while irregular particle sizes presents difficulties.

Therefore, the atomizing technique using water has not been applied to the manufacture of functional materials.

Third, in the case of the gas atomizing method, if the desired particle size is to be obtained, the pressure of the spouting gas has to be high. Therefore, entrapped pores are formed within the particles owing to the high pressure spouting gas. As a result, the characteristics of the powder are degraded.

That is, in the functional material of the present invention, the step of coating an insulating material has to be necessarily carried out, and the insulation coated powder has to be formed with a certain compression pressure. Even after the forming, the insulating layers should not be damaged.

Particularly, in the sendust core or MPP core, the forming pressure is about 18–24 ton/cm$^2$. Therefore, if the particle shape is irregular or if entrapped pores exist within the particles, a fatal result is invited.

Therefore, the atomizing technique has not been applied to the manufacture of the functional materials.

Meanwhile, in the case where a press formed iron core is manufactured by using a metal powder, the metal particles are insulated from one another for reducing the eddy current loss. Conventionally, sodium silicate or a polymer is used for insulating the particles, or the metal particles are slightly oxidized so as to insulate them.

However, in the case where the metal particles are insulated, the insulation resistance is low. Therefore, at 100 gausses, the core loss reaches 25–30 mW/cm$^2$.

SUMMARY OF THE INVENTION

In order to overcome the above described disadvantages of the conventional techniques, the present inventors carried out study and experiments, and has come to propose the present invention based on the study and experiments.

Therefore, it is the object of the present invention to provide a method for manufacturing a powder for a sendust core, in which the sendust powder is manufactured by applying the atomizing process, and the powder is coated with a special ceramic mixture insulator, so that the core loss is small after forming product.

In achieving the above object, the method for manufacturing a powder for a sendust core according to the present invention includes the steps of:

preparing a sendust alloy melt composed of (in wt %) 4–13% of Si, 4–7% of Al, and balance of Fe under an inert atmosphere;

spouting water with a pressure of 1500–3500 psi to a flow of said sendust alloy melt through four or more nozzles having a diameter of 10–20 mm, so as to form a relatively regular polyhedral powder;

adding 0.1–1.0 wt % of kaoline to said powder, and heat-treating it at a temperature of 700°–850° C. for 30 minutes or more under a reducing atmosphere; and carrying out a wet coating on the heat-treated powder by using 0.5–5% (relative to the weight of the powder) of a composite ceramic composed of milk of magnesia, kaoline and sodium silicate.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
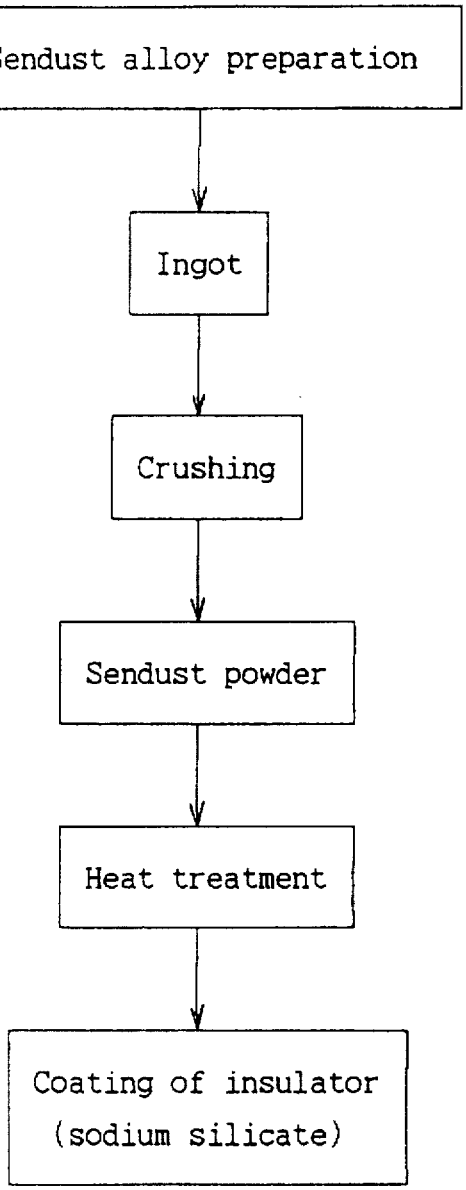
FIG. 1 is a flow chart showing the conventional process for manufacturing the powder for sendust core.
Figure 2:
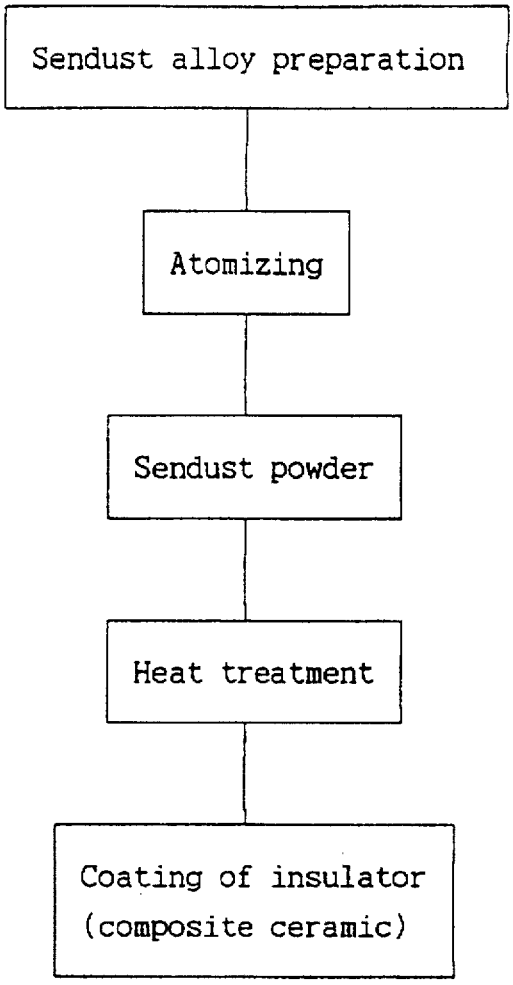
FIG. 2 is a flow chart showing the process for manufacturing the powder for sendust core according to the present invention.

If the powder for sendust core according to the present invention is to be manufactured, as shown in FIG. 2, a sendust melt has to be prepared. The sendust melt is composed of 4–13% of Si, 4–7% of Al, and balance of Fe, and is prepared under an inert gas atmosphere such as nitrogen ($N_2$) or argon (Ar).

When preparing the sendust alloy melt according to the present invention, ferro-silicon (Fe—Si), and ferro-aluminum (Fe—Al), Si and Al are used to adjust the composition of the melt rather than only the metallic Al and Si. The reason is that the alloy ingredients can be adjusted in a short period of time.

The reason why the melt is prepared under an inert atmosphere is as follows.

During the preparation of the melt, the Al and Si which are highly oxidable are oxidized and consumed into slag. Therefore, the ingredient adjustment for the alloy is not easy, and therefore, this has to be prevented. Further, another reason is for minimizing the lowering of the fluidity of the melt, which is caused by the melt oxidation.

Water supplied at a pressure of 1500–3500 psi is then spouted to a flow of said sendust alloy melt through four or more nozzles having a diameter of 10–20 mm, so as to form relatively regular polyhedral powder.

If the diameter of the nozzle is less than 10 mm, the atomizing time is extended. Consequently, clogging of the nozzles may occur, or excessively fine particles are formed, with the result that the formed powder has too low a permeability. On the other hand, if the diameter of the nozzles is more than 20 mm, coarse and almost spherical powder is obtained, with the result that the product forming becomes difficult, and that the loss becomes large. Therefore, the diameter of the nozzle should be preferably 10–20 mm.

The number of the nozzles is four or more, and the reason for it is as follows. If the number of the nozzles is less than four, the shape of the powder may become flake, and therefore, products having a large core loss are apt to be formed.

The nozzles should be preferably disposed equidistantly in the horizontal view. The reason is that if not equidistantly disposed, the powder may have an irregular elliptical shape.

Meanwhile, in a vertical view, the height difference between the highest nozzle and the lowest nozzle should be preferably 5–20 mm.

If the height difference is less than 5 mm, ordinary flake powder may be produced. On the other hand, if the height difference is more than 20 mm, lumps may adhere on the particles, thereby making the powder irregular.

In the case where the number of the nozzles is even, two nozzles having the largest mutually facing distance should have preferably the same height.

If the number of the nozzles is odd, the nozzles having the longest mutually facing distance form pairs, in such a manner that one nozzle forms only one pair. The nozzles forming this pair should have vertically same height.

One nozzle which does not form a pair should be preferably disposed between the nozzles of the pair in a vertical view. The reason is as follows. That is, if a nozzle which does not form a pair is disposed at the highest position or at the lowest position, the shape of the particles will become irregular.

Meanwhile, if the spouting pressure is less than 1500 psi, coarse and spherical powder is obtained, resulting in a great loss, as well as being weak in the formed strength. On the other hand, if the spouting pressure is more than 3500 psi, then the oxidation of the powder becomes severe. Further, the shape of the powder becomes irregular, and excessive fine particles are formed, so that forming into a core would be difficult. Further, the permeability is low, and therefore, optimum properties cannot be obtained.

Then, 0.1–1% of kaoline is put into the powder in weight % relative to the powder. Then it is heat-treated at a temperature of 700°–850° C. for 30 minutes or more under a hydrogen containing reducing atmosphere.

The hydrogen containing atmosphere is composed of hydrogen and nitrogen.

The reason for carrying out the heat treatment is for removing the oxides and impurities formed during the atomizing process. The reason for adding kaoline during the heat treatment is for preventing the agglomeration of the powder.

The temperature and time for the heat treatment are limited in view of the proper removal of the oxides and impurities which have been formed during the atomizing.

The heat-treated powder is adjusted as to its particle size, so that the particle size would be suitable to its application.

For example, when a product having a permeability of 125μ is to be manufactured, the particle distribution of the powder should be preferably 25% of 120 meshes (125 μm) or less, 20% of 200 meshes (75 μm) or less, and 55% of 325 meshes (45 μm). The tolerance for each mesh range is ±5%.

If a product having a permeability of 60μ is to be manufactured, the powder should preferably have a particle size of 325 meshes (45 μm) or less.

Then a composite ceramic is wet-coated on the above described heat-treated powder by using 0.5–5 wt % of composite ceramic relative to the total powder.

The composite ceramic is composed of magnesia, kaoline, and sodium silicate. It is also preferable to additionally add talc and potassium hydroxide.

The height difference of the nozzles was 10 mm.

Then kaoline powder in a amount of 0.5% was added to the above powder, and then, a reduction treatment was carried out at 700° C. for one hour under a hydrogen containing atmosphere (containing 25% of $N_2$ and 75% of $H_2$).

Then in order to manufacture a core having a permeability of 125μ, the particle size distribution was made to include: 24% of 120 meshes or below, 21% of 200 meshes or below, and 55% of 325 meshes or below.

Then on the heat treated powder, the composite ceramic of the present invention and sodium silicate as an insulating material were coated by using 1.2% of them.

The composite ceramic used here included talc, magnesia, kaoline, sodium silicate and potassium hydroxide. Further the composite ceramic had a resistivity of $300\times10^8$MΩ-cm and a density of 2.7 g/cm$^3$.

Then a core was manufactured by using the powder, and the core loss was checked, and the results are shown in Table 1 below.

The outside diameter of the core was 20 mmϕ, and the core loss was measured at 100 KHz and 100 gausses.

TABLE 1

| Test piece | Powder formation | Insulating condition | Nozzle dia (mm) | Fluid pressure (psi) | Core loss (mW/cm$^3$) | Powder shape |
|---|---|---|---|---|---|---|
| Conventional 1 | Crushing method | Oxidation | — | — | 30 | **Irregular polyhedral |
| Conventional 2 | Crushing method | Sodium silicate | — | — | 27 | Irregular polyhedral |
| Comparative | Inventive method | Sodium silicate (1.2%) | 13 | 1600 | 20 | *Almost regular polyhedral |
| Inventive | Inventive method | Composite ceramic (1.2%) | 13 | 1600 | 16 | Almost regular polyhedral |

*"Almost regular polyhedral" refers to powder particles having no sharp corners, and no second lumps (satellite).
**"irregular polyhedral" refers to powder particles having sharp corners.

In the composite ceramic, magnesia ia added to improve insulation, kaoline is added to strengthen the insulating layer, and sodium silicate is added as a binder. Talc serves as a lubricant for the insulating layer, and potassium hydroxide acts as an insulating agent.

After a baking of one hour at 700° C., the composite ceramic has a resistivity of $200\times10^6$MΩ-cm or more, and a density of 2.3–3.0 g/cm$^3$. This resistivity value of the composite ceramic is higher than the case of the sodium silicate insulation or than the case of the oxidation insulation.

After manufacturing the powder for sendust core in the above described manner, a sendust core is manufactured. In this case, the sendust core shows superior characteristics with a small loss.

Now the present invention will be described based on actual examples.

<EXAMPLE 1>

A melt which was composed of Fe-9.6% Si-5.5% Al was prepared under a nitrogen atmosphere by using ferro-Si, ferro-Al, Si and Al. To the flow of the melt, water was spouted through four nozzles having a diameter of 13 mm each, at a pressure of 1600 psi, thereby forming a powder.

As shown in Table 1 above, the inventive material which was coated with the composite ceramic of the present invention after being formed into the powder according to the present invention was low in the core loss compared with the conventional materials 1 and 2.

<EXAMPLE 2>

Based on the method of Example 1, an oxidation insulation, a sodium silicate insulation, and the composite ceramic insulation were carried out on the powder in manufacturing the final powder as shown in Table 2 below. The a core having an outside diameter of 20 mmϕ) was manufactured by using the above powder. Then the core loss was measured in the same manner as that of Example 1, and the measured results are shown in Table 2 below.

The composite ceramic used here included talc, magnesia, kaoline, sodium silicate and potassium hydroxide, while its resistivity was $300\times10^8$MΩ-cm, and its density was 2.7 g/cm$^3$.

TABLE 2

| Insulation | Core loss ($mW/cm^3$) | Powder shape |
|---|---|---|
| Oxidized insulation (1.2%) | 27 | Almost regular polyhedral |
| Sodium silicate insulation (1.2%) | 20 | Almost regular polyhedral |
| Composite ceramic insulation (1.2%) | 16 | Almost regular polyhedral |
| Composite ceramic insulation (1.4%) | 12 | Almost regular polyhedral |

<EXAMPLE 3>

By using ferro-Si, ferro-Al, Si and Al, there was prepared a melt of Fe-9.6% Si-5.5% Al under a nitrogen atmosphere. Then water was spouted to the flow of the melt at the conditions of Table 3 below, thereby forming a powder.

Then like in Example 1, a reduction treatment and an adjustment of the particle size distribution were carried out. The composite ceramic of the present invention was coated on the powder. Then a core of 20 mmϕ was formed by using the powder, and then, the core loss was measured in the same manner as that of Example 1. The measured results are shown in Table 3 below.

The composite ceramic used here included talc, magnesia, kaoline, sodium silicate and potassium hydroxide, while its resistivity was $300\times10^8 M\Omega$-cm, and its density was 2.7 $g/cm^3$.

TABLE 3

| Amount of insulator | Nozzle dia (mm) | Fluid pressure (psi) | Core loss ($mW/cm^3$) | Shape of powder |
|---|---|---|---|---|
| 1.2% | 9 | 1600 | 27 | Irregular polyhedral |
| 1.2% | 13 | 1600 | 16 | Almost regular polyhedral |
| 1.2% | 22 | 1600 | 20 | Almost coarse spherical |
| 1.2% | 13 | 1200 | 22 | Almost coarse spherical |
| 1.2% | 13 | 3800 | 23 | Tiny & irregular |
| 1.2% | 13 | 2000 | 12 | Almost regular polyhedral |
| 1.4% | 13 | 2000 | 10 | Almost regular polyhedral |
| 1.4% | 15 | 2700 | 8 | Almost regular polyhedral |

According to the present invention as described above, a melt is subjected to an atomizing process, and a quick cooling is carried out so as to manufacture a powder. Further, a composite ceramic is used to insulate the powder particles, so that the resistivity would be raised. Therefore, when the powder is formed into a sendust core, the core loss is lowered.

What is claimed is:

1. A method for manufacturing a powder for a sendust core, comprising the steps of:

preparing in an inert atmosphere a sendust alloy melt composed of 4–13 wt % of Si, 4–7 wt % of Al, and balance of Fe;

electing water with a pressure of 1500–3500 psi to a flow of said sendust alloy melt through at least four nozzles having a diameter of 10–20 mm, so as to form a substantially regular polyhedral powder;

adding 0.1–1.0 wt % of kaolin to said powder, and heat-treating said powder and kaolin at a temperature of 700°–850° C. for at least 30 minutes under a reducing atmosphere; and carrying out a wet coating on the heat-treated powder by using 0.5–5 wt %, relative to the weight of said powder, of a composite ceramic composed of milk of magnesia, kaolin and sodium silicate, said composite ceramic having a resistivity greater than $200\times10^6 M\Omega$-cm and a density of 2.3–3.0 $g/cm^3$ after baking for one hour, wherein said nozzles are disposed equidistantly from each other in a horizontal view, and a height difference between a highest nozzle and a lowest nozzle is about 5–20 mm.

2. The method as claimed in claim 1, wherein:

talc and potassium hydroxide are added to said composite ceramic.

3. The method as claimed in claim 1, wherein, when the number of said nozzles is even, two opposing nozzles are disposed at the same height, and when the number of said nozzles is odd, the nozzles are arranged to form mutually facing pairs in such a manner that one nozzle forms only one pair, the nozzle within the same pair having the same height, and the odd nozzle which does not form one of a pair being vertically disposed between nozzles forming one of a pair.

4. The method as claimed in claim 2, wherein, when the number of said nozzles is even, two opposing nozzles are disposed at the same height, and when the number of said nozzles is odd, the nozzles are arranged to form mutually facing pairs in such a manner that one nozzle forms only one pair, the nozzle within the same pair having the same height, and the odd nozzle which does not form one of a pair being vertically disposed between nozzles forming one of a pair.

* * * * *